US005369920A

United States Patent [19]

Taylor

[11] Patent Number: 5,369,920

[45] Date of Patent: Dec. 6, 1994

[54] MOTORCYCLE GARAGE

[76] Inventor: Gary L. Taylor, 715 S. Upas St., Escondido, Calif. 92025

[21] Appl. No.: 118,733

[22] Filed: Sep. 10, 1993

[51] Int. Cl.[5] ..... E04B 1/346

[52] U.S. Cl. ..... 52/79.1; 52/79.5; 52/64; 52/71; 446/488

[58] Field of Search ..... 52/79.1, 79.5, 64, 71; 446/423, 478, 488

[56] References Cited

U.S. PATENT DOCUMENTS

| | | | |
|---|---|---|---|
| 2,259,783 | 10/1941 | Sparling | 446/478 |
| 3,231,942 | 2/1966 | O'Brien | 446/478 |
| 3,465,765 | 12/1967 | Dietz | 135/3 |
| 3,774,357 | 11/1973 | Moore | 52/71 |
| 3,796,015 | 3/1974 | Kane | 52/64 |
| 3,913,968 | 10/1975 | Luppens | 135/88 |
| 3,945,159 | 3/1976 | Girnus, Sr. | 135/5 R |
| 3,996,704 | 12/1976 | Huey | 52/64 |
| 4,242,846 | 1/1981 | Hurd et al. | 52/71 |
| 4,633,626 | 1/1987 | Freeman et al. | 52/79.5 |
| 4,800,701 | 1/1989 | Dunsworth | 52/66 |
| 4,984,399 | 1/1991 | Taylor | 52/64 |
| 4,986,037 | 1/1991 | Jackson, Jr. | 52/67 |
| 5,044,132 | 9/1991 | Harman | 135/88 |
| 5,094,257 | 3/1992 | Wilson et al. | 135/88 |
| 5,265,385 | 11/1993 | Smith et al. | 52/79.5 |

*Primary Examiner*—Carl D. Friedman
*Assistant Examiner*—Wynn E. Wood
*Attorney, Agent, or Firm*—Calif Tervo

[57] ABSTRACT

A motorcycle garage generally comprises a floor member and an enclosure for motorcycle parked on the floor member. A lid, pivotable from a closed position to an open position, includes a roof portion and a wall portion. The wall portion lower edge is pivotable about a low hinge, thereby facilitating raising of the lid. The left side wall includes a front gate sideways outwardly pivotable from a vertically oriented hinge on its rear end from a closed to an open position.

9 Claims, 1 Drawing Sheet

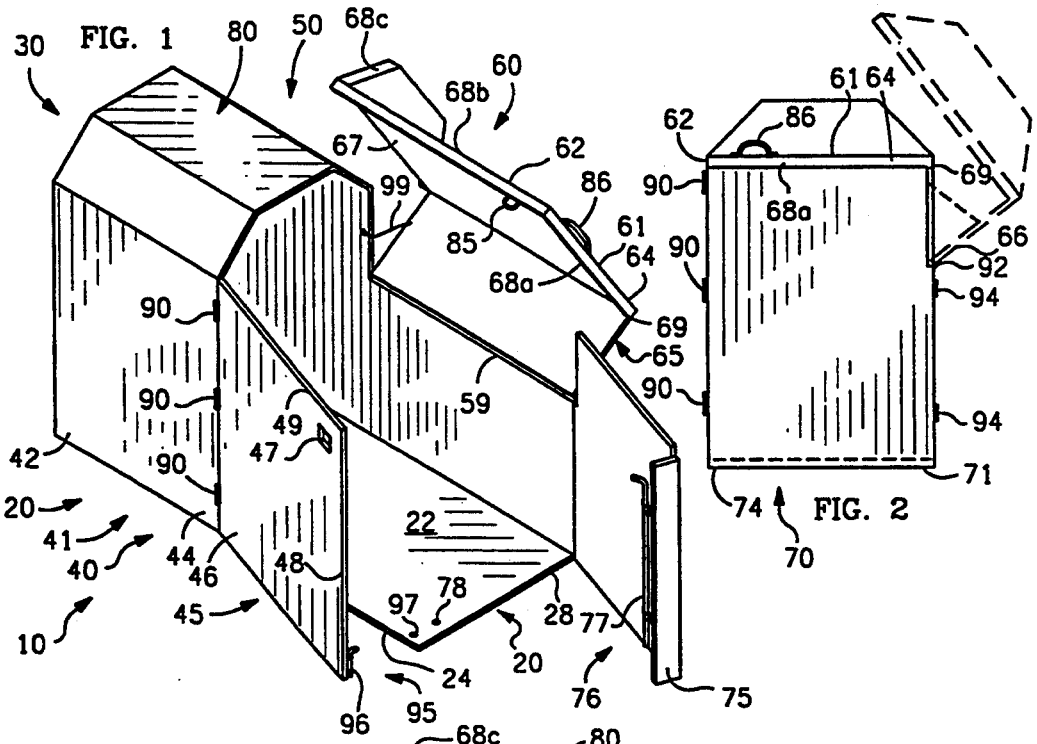
FIG. 1
FIG. 2
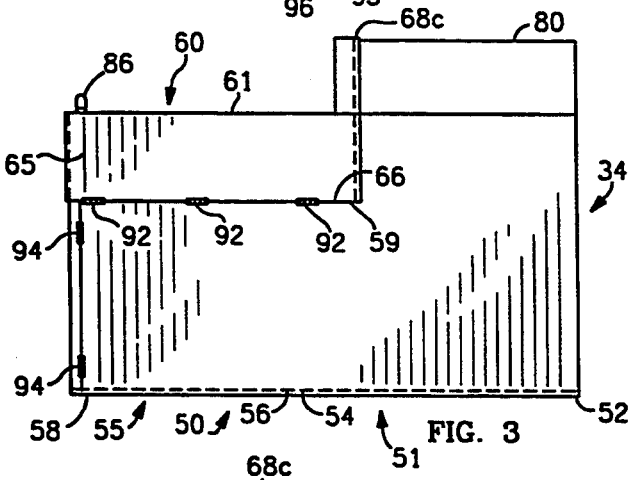
FIG. 3
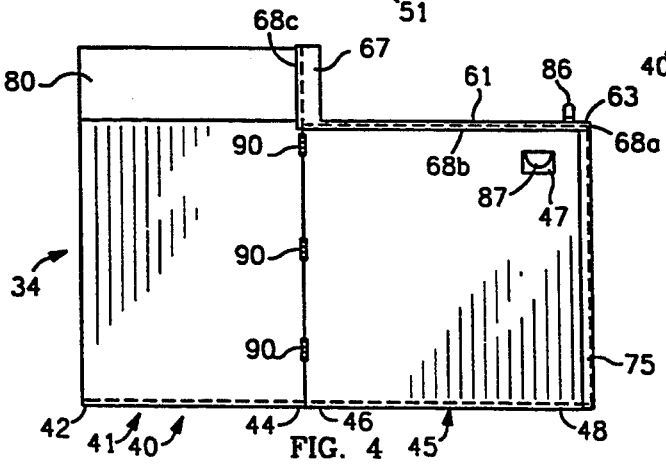
FIG. 4
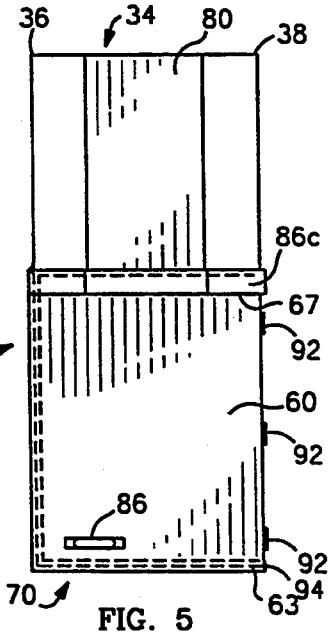
FIG. 5

MOTORCYCLE GARAGE

BACKGROUND OF THE INVENTION

1. Field of the Invention

This invention relates to garages for recreational vehicles and more particularly involves an enclosure specifically designed to house a motorcycle.

2. Description of the Related Art

It is highly desirable to garage a motorcycle to protect it from the elements and from theft and vandalizing.

Some prior art motorcycle garages are overly complicated and, consequently, are prohibitively expensive. Others require a large space for their operation and, consequently, are impractical. Many require the movement or lifting of large structures. Such garages are undesirable in that machinery is required to aid in the movement or are undesirable in that the operator must possess high strength.

Many prior art garages are designed to be used for storage of a variety of objects. Consequently, there has been a great deal of compromise built in. Therefore, there has been a need for a garage specifically designed to enclose a motorcycle.

Therefore, there has been a need for a very simplified and inexpensive motorcycle garage that occupies a minimum of space in its use and that requires no motors or hydraulics, yet can be operated with little strength.

SUMMARY OF THE INVENTION

This invention is a motorcycle garage and it generally comprises a floor member and an enclosure connected to the floor member and capable of enclosing a motorcycle parked on the floor member.

A preferred embodiment has a rear portion and a front portion. The rear portion defines an open fronted cell into which the front end of a motorcycle can be driven. The rear portion includes a rear wall, a left side wall, a right side wall and a roof. Preferably, the roof is high enough to accommodate the front of a motorcycle, including a windshield. The front portion, enclosing the portion of the motorcycle not housed in rear portion, includes at least two moveable enclosure structures for accommodating a motorcycle rider while parking the motorcycle.

A lid, pivotable from a closed position to an open position, includes a roof portion and a wall portion. The wall portion lower edge is pivotable about a low hinge, thereby facilitating raising of the lid.

The left side wall includes a front gate sideways outwardly pivotable by a vertically oriented hinge on its rear end from a closed position to an open position.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 1 is a perspective view of an exemplary embodiment of the motorcycle garage of the invention.

FIG. 2 is a front elevation view of the garage of FIG. 1.

FIG. 3 is a right side elevation view of the garage of FIG. 1.

FIG. 4 is a left side elevation view of the garage of FIG. 1.

FIG. 5 is a top plan view of the garage of FIG. 1.

DETAILED DESCRIPTION OF THE PREFERRED EMBODIMENT

With reference now to the drawings, and more particularly to FIG. 1 thereof, there is shown a perspective view of an exemplary embodiment of the motorcycle garage, denoted generally as 10, of the invention. FIG. 2 is a front elevation view, FIG. 3 is a right side elevation view, FIG. 4 is a left side elevation view, and FIG. 5 is a top plan view of the garage 10 of FIG. 1.

Garage 10 generally comprises a floor member, denoted generally as 20, and an enclosure, denoted generally as 30, connected to floor member 20 and capable of enclosing a motorcycle parked on floor member 20.

Floor member 20, shown is the exemplary embodiment, is a sheet of heavy plywood or the like having a top surface 22 upon which a motorcycle can be driven and parked and outer edges 24, 28 to which enclosure 30 can be attached. Many other configurations of floor member are possible which satisfy the requirement that floor member 20 be restrained from upward movement by a motorcycle in garage 10 and enclosure 30 be attached to floor member 20 such that enclosure 30 cannot be simply lifted off a garaged motorcycle. It is preferable also that floor member 20 be continuous so as to completely enclose a garaged motorcycle on all sides.

Enclosure 30 is connected to floor member by any suitable means well known in the art, such as screw fasteners and/or brackets, not shown. Preferably, the fasteners are not accessible from external to garage 10. Enclosure 30 has a width defining a lateral direction, a length defining a longitudinal direction and a height.

Enclosure 30 generally includes a traverse rear wall 34, a first longitudinal side wall, denoted generally as 40, a second longitudinal side wall denoted generally as 50, a lid, denoted generally as 60, a front door, denoted generally as 70, and a roof, denoted generally as 80.

Rear wall 34, enclosing the rear of enclosure 10, traverses the width of garage 10 between side walls 40,50 and the height between floor 20 and roof 80. Rear Wall 34 has a first end 36 and a second end 38. Although a flat wall is shown, rear wall 34 may be curved or of any other appropriate functional shape and the ends 36,38 may be faired into the side walls 40,50.

First side wall 40 is longitudinal and encloses the left side of garage 10. First side wall 40 includes a rear section 41 and a front section, gate 45. Rear section 41 has a rear end 42 connected to first end 36 of rear wall 34 and has a front end 44. Gate 45 includes a rear end 46, a front end 48 and a top edge 49. Gate rear end 46 is pivotally joined by vertically oriented hinge means, such as hinges 90, to rear section front end 44 such that gate 45 may swing from a closed enclosing position as seen in FIGS. 2–5 outwardly to the side to an open position as seen in FIG. 1.

Second side wall 50, longitudinally oriented and spaced opposite first side wall 40, encloses the right side of garage 10 of the exemplary embodiment. Second side wall 50 includes a rear section 51 and a front section 55. Rear section 51 includes a rear end 52 connected to second end 38 of rear wall 34 and a front end 54. Second side wall front section 55 includes a rear end 56 connected to the front end 54 of rear section 51, a front end 58 disposed near the front of garage 10 and a top edge 59 forming a lid-connection portion that is lower than its opposing first wall top edge 49.

Lid 60 is pivotable from a closed position, as seen in FIGS. 2–5, to an open position, as seen in FIG. 1 and in phantom in FIG. 2. Lid 60 includes a roof portion 61 and a wall portion 65. Roof portion 61 includes a free end 62 juxtaposed to first side wall top edge 49 when lid 60 is in the closed position and an attached end 64. The front edge 63 of roof portion 61 includes a locking lip 68*a* overlapping the top edge of front door 70 in the closed position. The free end 63 of roof portion 61 includes a locking lip 68*b* overlapping the top edge of first side wall 40, and particularly gate 45 in the closed position.

The rear end 67 of roof portion 61 includes a transition portion for mating with fixed roof 80 including lip 68*c* overlapping fixed roof 80 to cover the mating crack.

Wall portion 65 includes an upper edge 69 attached to roof portion attached end 64 and a lower edge 66 well below roof portion 61. Wall portion 65 extends upward as a continuation of second side wall 50 to a height approximate that of the opposed said first side wall top edge 49.

A longitudinally horizontally oriented hinge means 92 hingedly connects lower edge 66 to top edge 59 of front section 55 of second side wall 50 well below the height of roof portion 61. As best seen in phantom in FIG. 2, the low lid hinge 92 produces several desirable results. First, immediately, or almost immediately depending upon the angle of wall portion 65, upon starting to open lid 60, wall portion 65 and part of roof portion 61 swings outward past hinge 92 to partially balance out the force required to lift lid 60. Also, low hinge 92 greatly lowers the pivot point for roof portion 61 such that lid 60 does not have to be lifted as high to rotate it free of enclosure 30. Additionally, low lid hinge 92 lowers the maximum height through which lid 60 passes upon opening thereby diminishing overall space requirements for using garage 10. Means, such as chain 99, connects lid 60 to the remainder of enclosure 10 and hold lid 70 fairly upright, preventing lid 70 from pivoting all of the way over. A locking hinge arm could also be used in place of chain 99 to prevent accidental closing of lid 60. Handle 86, connected to roof portion, facilitates opening roof 60.

Roof 80 traverses between any said first side wall top edge and second side wall top edge not traversed by lid 60. Preferably, all roof portions are domed such that water, snow and the like fall off.

Front door 70 includes a hinged end 71 and a free end 74. A vertically oriented hinge means, such as door hinge 94, hinged connects door hinged end 71 to second side wall front end 58 such that front door 70 may be opened outward such that front door 70 is pivotable from a closed position with its periphery juxtaposed to side wall front ends 48,58 and lid 60 to an open position. Free end 74 includes a lip 75 overlapping the outside of first side wall 40 and further securing gate 45.

The preferred embodiment of garage 10 shown can be thought to have a rear portion 14 and a front portion 16. Rear portion 14 defines an open fronted cell into which the front end of a motorcycle can be driven including rear wall 30, left side wall rear portion 41, right side wall rear portion 51 and roof 80. Preferably, roof 80 is high enough to accommodate the front of a motorcycle, including a windshield. Front portion 16, enclosing the portion of the motorcycle not housed in rear portion 14, includes at least two moveable enclosure structures for accommodating a motorcycle rider while parking the motorcycle.

To make garage 10 as small, inexpensive, and unobtrusive as possible, it is desirable that the roof be as low as possible, theoretically just covering the motorcycle. However, it is also desirable that the rider be able to ride the motorcycle into the enclosure and be able to put the motorcycle on its stand and depart past any saddle bags and roll bars. Typically, the rider is the highest point on the combination and the rider is the highest object when the rider stands off the bike to put it on its stand. Therefore, at least the front roof should be removable, as shown in the preferred embodiment, to accommodate a rider. The rear roof can be fixed, as shown. This configuration may also be desirable for structural strength. Although, lid 60, shown and described, does not include the entire roof, it may such that the entire roof opens and, in the closed position, rear edge 67 of lid roof portion 61 is adjacent rear wall 34.

In some instances, gate 45 facilitates movement by the rider. For example, if garage 10 is made narrow, say three feet wide or if a particularly wide motorcycle is used, then gate 45 allows the rider easy access to and exit from a motorcycle parker in the garage.

Preferably, the fastening hardware of hinges 90,92,94 is unaccessible when enclosure 10 is closed and hinge pintles are not removable.

Various fastening mechanisms secure the enclosure upon closing up garage 10. First, gate 45 is swung shut and latched, such as by latching means 95 including sliding bolt 96 on the inside of gate 45 and receptacle 97. Next, front door 70 is closed. Lip 75 further secures gate 45. Latching means 76 includes slide bolt 77 and floor receptacle 78. Slide bolt 77 is accessible from over the top of door 70 for insertion into floor receptacle 78 for fastening door 70 to floor 20. Lid 60 is closed. Lip 68*a*, 68*b* further secure gate 45 and door 70. Lid 60 is latched to door 70 or gate 45 by suitable latching means. Gate 45 includes a built-in lock box 47 having an top receptacle just large enough for receiving a locking eye 85 on lid 70. A padlock 87 can be attached to the inserted eye. Locking box 47 prevents access to the shackle of lock 87.

Garage 10 of the preferred embodiment is three feet wide and eight feet long. If it is made four feet wide, gate 45 may not be as necessary. Fixed roof 80 is about five and one-half feet high. Lid roof 61 is about four and one-half feet high and lid hinge is three feet.

Having described the invention, it can be seen that it provides a very effective device for garaging a motorcycle. It takes up a minimum of space and requires no motors or other complicated and expensive machinery.

Although the various walls and panels are described as having ends or edges joined to another wall edge or end, it is understood that, with curved or faired lines such as between side walls and roof, such demarcations may not be apparent.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

I claim:

1. A motorcycle garage comprising:

a floor member for parking a motorcycle upon;

an enclosure connected to said floor member and having a width defining a lateral direction, a length defining a longitudinal direction and a height; said enclosure including:

a rear wall having:

a first end; and a second end;

a first side wall having;

a rear end connected to said rear wall first end;

a front end; and a top edge;

a second side wall, opposite said first side wall, including:

a rear end connected to said rear wall second end;

a front end; and a top edge including:

a lid-connection portion that is lower than its opposing said first wall top edge;

a lid pivotable from a closed position to an open position including:

a wall portion including:

an upper edge; and a lower edge including:

longitudinally horizontally oriented hinge means hingedly connecting said lower edge to said second side wall top edge lid-connection portion such that said lid may swing outward; said lid wall portion extending upward as a continuation of said second side wall to a height approximate that of the opposed said first side wall top edge; and a lid roof portion including:

a first edge connected to said lid wall portion upper edge; and a free end juxtaposed to said first side wall top edge when said lid is in the closed position;

a front door including:

a hinged end hingedly connected to the remainder of said enclosure such that said front door is pivotable from a closed position, juxtaposed to said side walls front ends and said lid, to an open position; and a roof traversing between any said first side wall top edge and said second side wall top edge not traversed by said lid roof portion;

said rear wall, said side walls, said front door, said lid and said roof, in the closed positions, enclosing a motorcycle parked on said floor member.

2. The motorcycle garage of claim 1 wherein:

said first side wall includes:

a rear section having:

a front end; and a front section pivotable from a closed to an open position including:

a rear end including;

vertically oriented hinge means hingedly connecting said rear end to said first side wall rear section front edge such that said first side wall front section may swing open outwardly to a side.

3. The motorcycle garage of claim 1 wherein:

said front wall hinged end includes:

vertically oriented hinge means hingedly connecting said hinged end to said second side wall front end such that said front door may be opened outward; and a free end juxtaposed to said first side wall front end when said front door is in the closed position.

4. A motorcycle garage comprising:

a floor member for parking a motorcycle upon;

an enclosure connected to said floor member and having a width defining a lateral direction, a length defining a longitudinal direction and a height; said enclosure including:

a rear portion defining an open front cell into which the front end of a motorcycle can be driven including:

a rear wall;

a left side wall;

a right side wall;

a roof; and a front portion for enclosing the portion of the motorcycle not housed in said rear portion; said front portion including at least two moveable enclosure structures for accommodating a motorcycle rider while parking the motorcycle including:

a first side wall having:

a rear end connected to said rear portion;

a front end; and a top edge;

a second side wall, opposite said first side wall, including:

a rear end connected to said rear portion;

a front end; and a top edge including:

a lid-connection portion that is lower than its opposing said first wall top edge;

a lid pivotable from a closed position to an open position including:

a wall portion including:

an upper edge; and a lower edge including:

longitudinally horizontally oriented hinge means hingedly connecting said lower edge to said second side wall top edge lid-connection portion such that said lid may swing outward; said lid wall portion extending upward as a continuation of said second side wall to a height approximate that of the opposed said first side wall top edge; and a roof portion including:

a first edge connected to said lid wall portion upper edge; and a free end juxtaposed to said first side wall top edge when said lid is in the closed position; and a front door including:

a hinged end hingedly connected to the remainder of said enclosure such that said front door is pivotable from a closed position, juxtaposed to said side walls front ends and said lid, to an open position;

said rear wall, said side walls, said front door, said lid and said roof, in the closed positions, enclosing a motorcycle parked on said floor member.

5. The motorcycle garage of claim 4 wherein:

said first side wall includes:

a rear section having:

a front end; and a front section pivotable from a closed to an open position including:

a rear end including;

vertically oriented hinge means hingedly connecting said rear end to said first side wall rear section front edge such that said first side wall front section may swing open outwardly to a side.

6. The motorcycle garage of claim 4 wherein:

said front door hinged end includes:

vertically oriented hinge means hingedly connecting said hinged end to said second side wall front end such that said front door may be opened outward; and a free end juxtaposed to said first side wall front end when said front door is in the closed position.

7. A motorcycle garage comprising:

a floor member for parking a motorcycle upon;

an enclosure connected to said floor member and having a width defining a lateral direction, a length defining a longitudinal direction and a height; said enclosure including:

a traverse rear wall;

a first longitudinal side wall having;

a rear end connected to said rear wall;

a front end; and a top edge;

a second longitudinal side wall, spaced opposite said first side wall, including:

a rear end connected to said rear wall;

a front end; and a top edge including:

a lid pivotable from a closed position to an open position including:

a roof portion including:

a free end juxtaposed to said first side wall top edge when said lid is in the closed position; and an attached end; and a wall portion including:

an upper edge attached to said roof portion attached end; and a lower edge well below said roof portion including:

longitudinally horizontally oriented hinge means hingedly connecting said lower edge to said second side wall well below the height of said roof portion such that said lid wall portion may swing outward;

a front door including:

a hinged end hingedly connected to the remainder of said enclosure such that said front door is pivotable from a closed position, juxtaposed to said side walls front ends and said lid, to an open position; and a roof traversing between any said first side wall top edge and said second side wall top edge not traversed by said lid roof portion;

said rear wall, said side walls, said front door, said lid and said roof, in the closed positions, enclosing a motorcycle parked on said floor member, and in the open positions.

8. The motorcycle garage of claim 7 wherein:

said first side wall includes:

a rear section having:

a front end; and a front section pivotable from a closed to an open position including:

a rear end including;

vertically oriented hinge means hingedly connecting said rear end to said first side wall rear section front edge such that said first side wall front section may swing open outwardly to a side.

9. The motorcycle garage of claim 7 wherein:

said front wall hinged end includes:

vertically oriented hinge means hingedly connecting said hinged end to said second side wall front end such that said front door may be opened outward; and a free end juxtaposed to said first side wall front end when said front door is in the closed position.

* * * * *